US007081173B2

(12) United States Patent
Bahar et al.

(10) Patent No.: US 7,081,173 B2
(45) **Date of Patent: *Jul. 25, 2006**

(54) SUPER-AUSTENITIC STAINLESS STEEL

(75) Inventors: Babak Bahar, Sandviken (SE); Johan Frodigh, Sandivken (SE); Pasi Kangas, Sandviken (SE); Ulf Kivisäkk, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 37 days.

This patent is subject to a terminal disclaimer.

(21) Appl. No.: 10/301,736

(22) Filed: Nov. 22, 2002

(65) Prior Publication Data

US 2003/0143105 A1 Jul. 31, 2003

(30) Foreign Application Priority Data

Nov. 22, 2001 (SE) ..... 0103938

(51) Int. Cl.
*C22C 38/18* (2006.01)

(52) U.S. Cl. ..... 148/325; 148/327

(58) Field of Classification Search ..... 148/325, 148/327

See application file for complete search history.

(56) References Cited

U.S. PATENT DOCUMENTS 2,684,298 A * 7/1954 Henke ..... 420/40
3,119,687 A * 1/1964 Hans ..... 420/40
3,992,161 A 11/1976 Cairns et al.
4,302,247 A 11/1981 Abe et al.
4,400,210 A 8/1983 Kudo et al.
4,400,349 A 8/1983 Kudo et al.
4,414,023 A 11/1983 Aggen et al.
4,824,638 A 4/1989 Culling (Continued)

FOREIGN PATENT DOCUMENTS

EP 0 646 657 9/1994

(Continued)

OTHER PUBLICATIONS

Co-pending U.S. Appl. No. 10/261,416; Inventors: Magnus Cedergren et al.; filed Oct. 2, 2002.

*Primary Examiner*—Sikyin Ip
(74) *Attorney, Agent, or Firm*—Drinker, Biddle & Reath LLP

(57) ABSTRACT

A super-austenitic stainless steel alloy with a composition, balanced in such a way that products made from the alloy fulfill high requirements on a combination of high corrosion resistance, especially in inorganic and organic acids and mixtures thereof, good general corrosion resistance, good structure stability as well as improved mechanical properties in combination with good workability, in particular in tubes, especially seamless tubes and seam welded tubes for application in these environments and with following composition, in weight-percent:

| | |
|---|---|
| Cr | 23.0–30.0 |
| Ni | 25.0–35.0 |
| Mo | 2.0–6.0 |
| Mn | 1.0–6.0 |
| N | 0–0.4 |
| C | up to 0.05 |
| Si | up to 1.0 |
| S | up to 0.02 |
| Cu | up to 3.0 |
| W | 0–6.0 |

up to 2.0 of one or more element of the group Mg, Ce, Ca, B, La, Pr, Zr, Ti, Nd, and the balance being Fe and normally occurring impurities and steel making additions.

28 Claims, 4 Drawing Sheets

U.S. PATENT DOCUMENTS

| | | | |
|---|---|---|---|
| 4,859,649 | A | 8/1989 | Böhnke et al. |
| 4,876,056 | A | 10/1989 | Clayton et al. |
| 5,130,085 | A | 7/1992 | Tendo et al. |
| 5,141,705 | A | 8/1992 | Stenvall et al. |
| 5,480,609 | A | 1/1996 | Dupoiron et al. |
| 5,866,065 | A | 2/1999 | Herbelin et al. |
| 6,197,132 | B1 | 3/2001 | Andersson-Drugge |
| 2002/0021980 | A1 | 2/2002 | Ulfvin et al. |
| 2002/0124913 | A1 | 9/2002 | Uehara et al. |

FOREIGN PATENT DOCUMENTS

| | | | |
|---|---|---|---|
| EP | 6 667 400 | | 8/1995 |
| JP | 57-171651 | | 10/1982 |
| JP | 57-207147 | | 12/1982 |
| JP | 6-0224763 | | 11/1985 |
| JP | 61227152 | * | 10/1986 |
| JP | 1-262048 | | 10/1989 |
| JP | 5-247597 | | 9/1993 |
| JP | 6-136442 | | 5/1994 |
| JP | 6-336659 | | 12/1994 |
| JP | 2000001755 | * | 1/2000 |
| JP | 2001181800 | * | 7/2001 |
| SE | 465 373 | | 9/1991 |
| WO | 02/02837 | | 1/2002 |

* cited by examiner

SUPER-AUSTENITIC STAINLESS STEEL

FIELD OF THE INVENTION

The present invention relates to a super-austenitic stainless steel alloy with a composition balanced in such a way that the alloy and products produced from the alloy possesses a combination of high corrosion resistance, especially in inorganic and organic acids and mixtures thereof, good general corrosion resistance, good structure stability as well as improved mechanical properties and good workability. In particular, one embodiment the invention is directed to tubes, especially seamless tubes and seam-welded tubes for use in environments requiring the above-mentioned properties.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Austenitic steel with optimized properties is used in many different applications and is a common alternative to, for instance, nickel-base alloys. The disadvantage with the latter is the elevated price for the raw material needed to make these alloys.

Primarily, the choice of steel grade is determined by the requirements of corrosion resistance, workability as well as structural stability. Highly alloyed austenitic stainless steels are found in a range of different embodiments for corrosive environments within, for example, the chemical industry, especially in the production of organic and inorganic acids for the production of oil products and for seawater cooling.

The use is, to a large extent, limited by the corrosion resistance. Also, high alloying levels cause problems with both the workability by hot-extrusion and cold-rolling, as well as a decrease in structural stability. These problems are observed with increasing alloying levels of, in particular, the elements Cr, Mo, N, W, Cu and Mn.

The developed alloys are generally characterized in that one tries to find a composition which obtains high corrosion resistance within a broad range of chemical environments. The high alloying levels come with a high price compared to lower alloyed material. In particular, nickel-base alloys are considered as being very expensive. Highly alloyed austenitic alloys with a lower content of nickel but with a high alloying level are frequently limited by their workability, which means that it is difficult to hot-extrude seamless tubes of the alloy or cold-roll the material to suitable final dimension.

The high price means that the market for these types of alloys is relatively limited. Thus, there is a need to develop an all-round material in order to be able to offer a type of alloy for different applications, and offers advantages in the form of cost savings for production and stock-keeping.

It is a disadvantage with the known highly alloyed austenitic steel grades, such as SE 465373, which is hereby incorporated by reference, or nickel-base alloys such as Alloy 59, that structural stability can only be managed within a very narrow temperature range, which causes problems with the production of heavier structures. In addition, subsequent treatment such as welding becomes more complicated. Deteriorated structural stability entails deteriorated corrosion resistance and shorter life time for products produced of these alloys in applications for use in environments requiring the above-mentioned properties.

SUMMARY OF THE INVENTION

It is therefore an object of the present invention to provide a stainless steel alloy, in particular a super-austenitic stainless steel alloy with high corrosion resistance in inorganic and organic acids and mixtures thereof, as well as a good general corrosion resistance.

It is a further object of the present invention to provide a super-austenitic stainless steel alloy with good structural stability and improved mechanical properties in combination with good workability, particularly in tubes, especially seamless tubes for use in environments requiring the above-mentioned properties.

These objects are fulfilled with an alloy according to the present invention, which contains (in weight-%):

| | |
|---|---|
| Cr | 23.0–30.0 |
| Ni | 25.0–35.0 |
| Mo | 2.0–6.0 |
| Mn | 1.0–6.0 |
| N | 0–0.4 |
| C | up to 0.05 |
| Si | up to 1.0 |
| S | up to 0.02 |
| Cu | up to 3.0 |
| W | 0–6.0 |

up to 2.0 of one or more elements of the group Mg, Ce, Ca, B, La, Pr, Zr, Ti, and Nd, and the balance being Fe and normally occurring impurities and steel making additions.

According to another aspect, the present invention provides a tube, such as a seamless or welded heat exchanger tube exposed to chloride environments which is formed from the above-defined alloy.

DETAILED DESCRIPTION OF THE INVENTION

Figure 1:
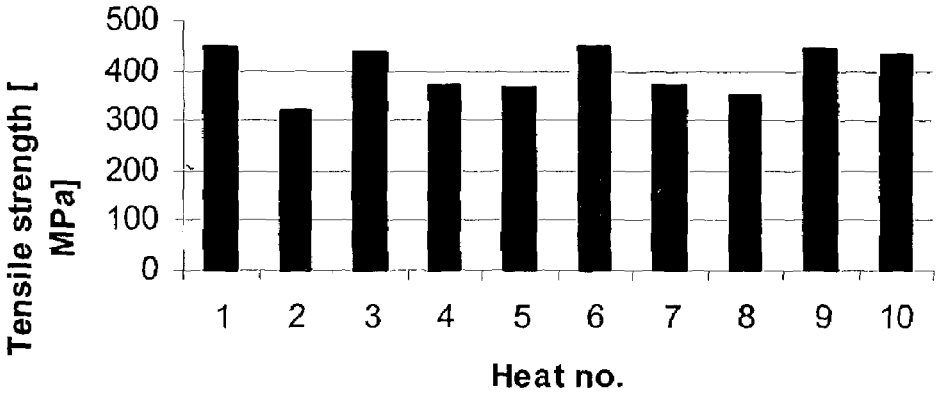
FIG. 1 shows yield point in tension for the heats 1 to 10 according to the invention at room temperature.

A systematic development work has surprisingly shown that an alloy with an alloying content according to the present invention shows these desired properties.

An alloy according to the invention contains, in weight-percent:

| | |
|---|---|
| Cr | 23.0–30.0 |
| Ni | 25.0–35.0 |
| Mo | 2.0–6.0 |
| Mn | 1.0–6.0 |
| N | 0–0.4 |
| C | up to 0.05 |
| Si | up to 1.0 |
| S | up to 0.02 |
| Cu | up to 3.0 |
| W | 0–6.0 |

up to 2.0 of one or more element of the group of Mg, Ce, Ca, B, La, Pr, Zr, Ti, and Nd, and the balance being Fe and normally occurring impurities and steel making additions.

In one exemplary embodiment, the alloy has a content of N greater than zero, a content of C greater than zero, a content of Si greater than zero, and a content of S greater than zero.

Chromium (Cr)

Chromium is a very active element with the purpose to improve the resistance to the plurality of corrosion types, such as general corrosion and corrosion in acid environments, especially where contaminated acids are present. Besides, a high content of chromium is desirable in order to enable the addition of nitrogen into the alloy in sufficient contents. Thus, it is desirable to keep the content of chromium as high as possible in order to improve the corrosion resistance. Therefore, the content of chromium should be 23.0–30.0 weight-% and be preferably at least 24.0 weight-%, more preferably at least 27.0 weight-%. However, too high contents of chromium increase the risk for intermetallic precipitations, for this reason the content should be limited up to max 30.0 weight-%, preferably to 29.0 weight-%.

Nickel (Ni)

A high content of nickel homogenizes high alloyed steel by increasing the solubility of Cr and Mo. Thereby the austenite stabilizing nickel suppresses the forming of the unwanted phases sigma-, laves- and chi-phase, which to a large extent consist of the alloying elements chromium and molybdenum. However, a disadvantage is that nickel decreases the solubility of nitrogen in the alloy and detonates the hot-workability, which calls for an upper limitation on the content of nickel in the alloy. However, the present invention has shown that high contents of nitrogen can be tolerated by balancing the high content of nickel to high chromium- and manganese-contents. Therefore the content of nickel of the alloy should be limited to 25.0–35.0 weight-%, preferably at least 26.0 weight-%, more preferably at least 30.0 weight-% most preferably 31.0 weight-%, and preferably a maximum of 34.0 weight-%.

Molybdenum (Mo)

In modern corrosion resistant austenitic steels frequently a high alloying addition of molybdenum is used in order to increase the resistance to corrosion attacks in, for example, reducing acids and oxidizing chloride environments. However, molybdenum in high contents can, dependent on the total composition of the alloy, increase the corrosion rate, i.e., decrease the corrosion resistance. The explanation is that the precipitation inclination of molybdenum can give rise to unwanted phases. Therefore, a high content of chromium is chosen instead of a high content of molybdenum to provide the desired corrosion resistance while maintaining an optimum structural stability of the alloy. Certainly both alloying elements increase the precipitation inclination, but tests show that molybdenum does so twice as much as chromium. In the present alloy it is possible to wholly or partly replace the amount of molybdenum with tungsten. However, the alloy should preferably contain at least 2.0 weight-% molybdenum. The content of molybdenum should therefore be limited to 2.0 to 6.0 weight-%, preferably to at least 3.7 weight-%, more preferably to at least 4.0 weight-%. The upper limit for the content of molybdenum is preferably 6.0 weight-%, more preferably 5.5 weight-%.

Manganese (Mn)

Manganese is important to the alloy because of three reasons. For the final product a high strength will be desired, for this reason the alloy should be strain hardened during cold working. Both nitrogen and manganese are known for decreasing the stacking fault energy, which in turn leads to dislocations in the material that dissociate and form Shockley-particles. The lower the stacking fault energy the greater the distance between the Shockley-particles and the more aggravated the transversal sideslipping of the dislocations, be which makes that the material more easily strain hardened. For these reasons, high contents of manganese and nitrogen are important for the alloy. Furthermore, manganese increases the solubility of nitrogen in the melt, which favors a high content of manganese. The high content of chromium alone does not make the solubility sufficient since the content of nickel, which decreases the solubility, was chosen higher than the content of chromium. A third reason for a content of manganese in the range for the present invention is that a yield stress analysis made at increased temperature has surprisingly shown the improving effect of manganese on the hot workability of the alloy. The higher alloyed the steels become, the more difficult they will be to work, and the more important the additions for the workability improvement become, which both simplify and make the production cheaper. The good hot workability makes the alloy excellent for the production of tubes, wire and strip etc. Therefore the content of manganese is 1.0–6.0 weight-%, but preferably be higher than 2.0 weight-%, preferably higher than 3.0 weight-% and preferably 4.0 to 6.0 weight-%.

Carbon (C)

Carbon has limited solubility in both ferrite and austenite. The limited solubility causes a threat of precipitation of chromium carbides and therefore the content should not exceed 0.05 weight-%, preferably not exceed 0.03 weight-%.

Silicon (Si)

Silicon is utilized as a deoxidation agent during steel production, and increases the flowability during preparation and welding. However, excessive contents of silicon lead to precipitation of unwanted intermetallic phases. For this reason the content should be limited to max 1.0 weight-%, preferably max 0.8 weight-%, more preferably to 0.4 weight-%.

Sulfur (S)

Sulfur negatively influences the corrosion resistance by forming easily soluble sulfides. Moreover, it deteriorates the hot workability. For these reasons, the content of sulfur is limited to max 0.02 weight-%.

Nitrogen (N)

Nitrogen is like molybdenum and is a popular alloying element in modern corrosion resistant austenites in order to strongly elevate the corrosion resistance in an oxidizing chloride environment, as well as the mechanical strength of an alloy. In addition, nitrogen has the positive effect of strongly subduing the formation of intermetallic phases. The upper content is limited by the solubility of nitrogen in the melt and at casting, while the lower amount is limited by structural stability and austenite stability issues. For the present alloy, it is more important that the impact of nitrogen on the increase in mechanical strength is utilized. Nitrogen, like manganese, decreases the stacking fault energy of the alloy attains a strong increase in tensile strength at cold-deformation, such as mentioned above. The invention utilizes nitrogen at amounts which elevate the mechanical strength of the alloy as a result of interstitial soluted atoms, which cause tensions in the crystal structure. By using a high-strength material it is possible to obtain the same strength, but with less material consumption, and thus lower weight. However, this also increases the requirements on the ductility of the material. Therefore, the content of nitrogen should be 0.20–0.40 weight-%.

Copper (Cu)

The influence of copper on the corrosion properties of austenitic steel grades is disputed. However, it is believed clear that copper strongly improves corrosion resistance in sulfuric acid, which is important for alloys in fields of application having a sulfuric-acid containing environment. In tests, copper appeared to be an element which is favorable from a production point of view, especially for the production of tubes. For this reason, an addition of copper is important for material made for tube applications. However, it has been learned by experience that a high content of copper in combination with a high content of manganese strongly deteriorates hot-ductility. For this reason, the upper limit for the content of copper is determined to be 3.0 weight-%. The content of copper is preferably max 1.5 weight-%.

Tungsten (W)

Tungsten increases the resistance to pitting and stress-corrosion cracking. But alloying with excessive contents of tungsten, in combination with high contents of chromium and molybdenum increases the risk for intermetallic precipitations. Therefore, the content of tungsten should be 0 to 6.0 weight-%, preferably 0 to 4.0 weight-%.

Ductility Addition

At least one of the elements of the group of magnesium (Mg), calcium (Ca), cerium (Ce), boron (B), lanthanum (La), praseodynium (Pr), zirconium (Zr), titanium (Ti) and neodynium (Nd) should be added in an amount of up to a total of 2.0 weight-% in order to improve the hot-workability.

EXAMPLES

Illustrative but non-limiting embodiments and comparative examples of the present invention are presented as follows:

Table 1 shows the compositions for the tested alloys according to the invention, and for a known alloy, which are presented for comparison. 11 pieces 170-kg test ingots were produced in a HF-vacuum furnace. Further, a 2.2 ton full-scale-ingot was produced whose composition is shown as heat no. 12. The heat number and composition for the test ingots appear from Table 1:

TABLE 1

| Heat no. | Composition of tested material (weight-%) | | | | | | | | |
|---|---|---|---|---|---|---|---|---|---|
| | C | Si | Mn | Cr | Ni | Mo | Cu | N | Ce |
| 1 | 0.015 | 0.22 | 5.16 | 27.00 | 34.12 | 6.60 | 1.42 | 0.38 | 0.06 |
| 2 | 0.015 | 0.24 | 4.92 | 23.19 | 34.13 | 3.77 | 0.54 | 0.24 | 0.06 |
| 3 | 0.015 | 0.22 | 1.03 | 27.71 | 34.86 | 3.97 | 0.50 | 0.41 | 0.03 |
| 4 | 0.014 | 0.24 | 1.02 | 23.60 | 34.88 | 6.88 | 1.44 | 0.26 | 0.05 |
| 5 | 0.015 | 0.23 | 4.99 | 23.68 | 24.67 | 3.89 | 1.45 | 0.37 | 0.03 |
| 6 | 0.016 | 0.26 | 1.10 | 24.16 | 25.10 | 7.00 | 0.50 | 0.38 | 0.02 |
| 7 | 0.017 | 0.27 | 5.06 | 26.23 | 29.48 | 6.20 | 0.45 | 0.22 | 0.04 |
| 8 | 0.017 | 0.24 | 1.14 | 27.72 | 29.87 | 3.91 | 1.48 | 0.25 | 0.04 |
| 9 | 0.015 | 0.23 | 1.07 | 24.16 | 25.07 | 6.91 | 0.52 | 0.37 | 0.04 |
| 10 | 0.019 | 0.24 | 4.71 | 27.44 | 34.17 | 6.54 | 1.38 | 0.39 | <0.01 |
| 11 | 0.011 | 0.27 | 5.1 | 26.5 | 33.7 | 5.9 | 0.011 | 0.38 | 0.03 |
| 12 | 0.012 | 0.34 | 5.04 | 26.44 | 33.96 | 5.26 | 0.080 | 0.080 | 0.01 |
| A | 0.004 | 0.05 | 0.03 | 22.3 | 60.0 | 16.0 | 0.011 | 0.002 | |
| B | 0.020 | | 3 | 24 | 22 | 7.3 | 0.5 | 0.50 | |
| C | ≦0.02 | ≦1 | ≦1 | 20 | 25 | 6.5 | 1 | 0.2 | |

Heat A corresponds to Alloy 59, heat B corresponds to Alloy 654 SMO, and heat C corresponds to UNS N08926. From all ingots test material was produced by forging, extrusion, heat-treating, turning/milling and finally heat-treating, which was executed at 1120° C. for 30 min. followed by water quenching.

For the known alloys (A–C) being used as references, the compositions indicated in Table 1 for compositions which were tested lie within the standard composition for the alloy.

Example 1

The resistance to general corrosion was measured by exposing the steel according to the present invention for the following environments:

1.5% HCl at boiling temperature;

30% $H_2SO_4$ at 80° C.;

50% $H_2SO_4$ at 90° C.;

mixture of 25% formic acid +50% acetic acid and 2000 ppm $Cl^-$; and

43% $H_3PO_4$ contaminated with 41.9% $P_2O_5$+1.8% $F^-$ at 90° C.

Double variant tests were made on each material in a respective solution. The testing was performed according to the following procedure: exposure in three periods, 1+3+3 days, activating in the beginning of each period with strip of Zn. Results of the individual specimens were taken as an average of the corrosion rate during periods 2 and 3. The results from the tests can be summarized according to the following:

| | Corrosion rate (mm/year) |
|---|---|
| 1.5% HCl at boiling temperature | 1–2.5 |
| 30% $H_2SO_4$ at 80° C. | 0 |
| 50% $H_2SO_4$ AT 90° C., | 0.35–0.55 |
| mixture of 25% formic acid + 50% acetic acid and 2000 ppm $Cl^-$ | 0–0.02 |
| 43% $H_3PO_4$ contaminated with 41.9% $P_2O_5$ + 1.8% $F^-$ at 90° C. | |
| 654 SMO | 0.0581 |
| Heat 10 | 0.0469 |
| Heat 11 | 0.0438 |

Example 2

Within the process-, refinery- and oil- and gas-industries, among others, it is normal to cool different agents with treated or untreated seawater. A typical technique is that one uses a tubular heat exchanger with tubes that either are welded or introduced into in a tube gable. It is not totally unusual for a tube heat exchanger to have tubes that are bent in a U-shape, and both the inlet and the outlet is done in the same tube gable. When these u-shaped tubes are produced, cold working is done in the bend, and a stress-relieving annealing can follow. The tubular part is cooled with seawater whereby good corrosion resistance in chloride containing environments, especially seawater, is required. Corrosion in seawater is exhibited by chloride induced local corrosion. The standard-method ASTM G48A will be used as the test method for local corrosion in seawater, which is thought to simulate chlorinated seawater, the most corrosive state of seawater. It is established that cold working diminishes resistance to local corrosion.

Subsequently test specimen were taken out, which were cold-worked with a reduction rate of 60% and which then were tested according to the standard ASTM G48C, whereby a value for the Critical Pitting Temperature (CPT) of 92.5° C. was obtained. For a cold-worked specimen with a reduction rate of 60% for the reference steel UNS N08926, a CPT-value of 64° C. was obtained. 254 SMO, which has a CPT-value of 87° C. in annealed condition, obtains only a 62.5° C. to 72.5° C. in CPT-value in cold-worked condition. However, the CPT-value of 92.5° C. for the alloy according to the invention in cold-worked condition is very close to the CPT-value of 100° C., which was obtained in tests of the same material in annealed condition. Accordingly, the alloy according to the invention shows a very good resistance to local corrosion in seawater irrespective the degree of cold working or whether the stress-retaining annealing was done or not. This makes the alloy and products manufactured of this alloy, such as tubes, especially seamless and seam-welded tubes, very suitable for use in the application of seawater cooling.

Example 3

In order to find a suitable temperature for heat-treating, annealing tests were performed on 8 heats at different temperatures during 1 hour. The results of subsequent studies on the microstructure can be summarized according to Table 2:

Table 2 shows microstructure stability at different temperatures (° C.)

| Heat no. | 1050 | 1075 | 1100 | 1125 | 1150 | 1175 | 1200 | 1225 | 1250 |
|---|---|---|---|---|---|---|---|---|---|
| 1 | — | — | — | — | — | ○ | ○ | ○ | ○ |
| 2 | — | ○ | ○ | ○ | ○ | — | — | — | — |
| 3 | — | — | — | X | X | ○ | ○ | ○ | ○ |
| 4 | — | — | X | X | ○ | ○ | — | — | — |
| 5 | ○ | ○ | ○ | ○ | ○ | — | — | — | — |
| 6 | — | — | — | — | — | X | x | x | ○ |

○ no precipitations
— not tested
x trace
X phase

The annealing series performed shows that all variants exhibit a clean austenitic structure at 1250° C.

Example 4

In order to examine hot-workability, variants 1–10 were tested by Gleeble testing in order to determine the suitable forging temperature. The data obtained was evaluated with regard to the maximum ductility as well as the burning temperature, which is defined as 0% ductility. The results can be summarized with the assistance of following equations:

Maximum Ductility:

$$129.8-1.86\%\ Mn-87.86\%\ N-7.48\%\ Mo$$

$T_{burning}$:

$$1269-1.09\%\ Ni-3.1\%\ Mn+4.1\%\ Cr-128.6\%\ N-8.6\%\ Mo$$

The results for these equations for heats according to the invention and the reference heats are shown in Table 3:

TABLE 3

| Heat | Max. ductility [%] | $T_{burning}$ [° C.] |
|---|---|---|
| 1 | 37.4476 | 1221.113 |
| 2 | 71.3628 | 1248.483 |
| 3 | 62.1660 | 1254.799 |
| 4 | 53.5968 | 1232.131 |
| 5 | 58.9132 | 1242.915 |
| 6 | 42.0072 | 1228.447 |
| 7 | 54.6832 | 1247.244 |
| 9 | 43.6148 | 1230.627 |
| 10 | 37.8548 | 1223.494 |
| 11 | 42.7952 | 1225.727 |
| 12 | 74.0520 | 1269.288 |
| A | 9.88848 | 1157.081 |
| B | 25.6860 | 1207.340 |
| C | 61.7480 | 1239.150 |

The relationship between the deterioration of maximum ductility during Gleeble testing and the content of manganese corresponds with the forming of manganese sulfides in the grain boundaries. In addition, manganese, nitrogen and molybdenum are negative for hot-ductility, molybdenum and nitrogen have a solution hardening effect and make the recrystallization more difficult, which gives a distinct result on the hot-ductility.

Nickel, manganese, nitrogen and molybdenum decrease the burning temperature, while chromium increases it. In order to achieve a steel that is good from a hot-working point of view, the content of chromium should instead be held as high as possible. In order to stabilize the alloy, nickel should, to a certain extent replace nitrogen. Then nitrogen and molybdenum are added, up to the desired corrosion resistance. Manganese will be totally avoided and the desired nitrogen solubility will instead be obtained by increasing the content of chromium.

Example 5

Tests according to the standard ASTM G48 A were executed on material from all variants, except heat 8. The starting temperature was 25° C. for all variants, except heats 11 and 12, which were tested at a starting temperature of 50° C. Double tests were made. The rise in temperature was 5° C. for all samples. The test solution, which was used, was the usual, 6% $FeCl_3$ without any addition of HCl. The results was taken as average of CPT for the two specimens. The results from the best variants show that pitting corrosion does not occur at the highest test temperature, which was 100° C. The electro-chemical testing was performed on all heats, except heat no. 8. In this case the environment was 3% NaCl-solution and the applied potential was 600 mV, SCE. The starting temperature was 20° C., which then was stepped up by 5° C. Six specimens from each material heat were tested. The results from electrochemical testing appeared to be a CPT-value of between 85–95° C.

Example 6

Figure 2:
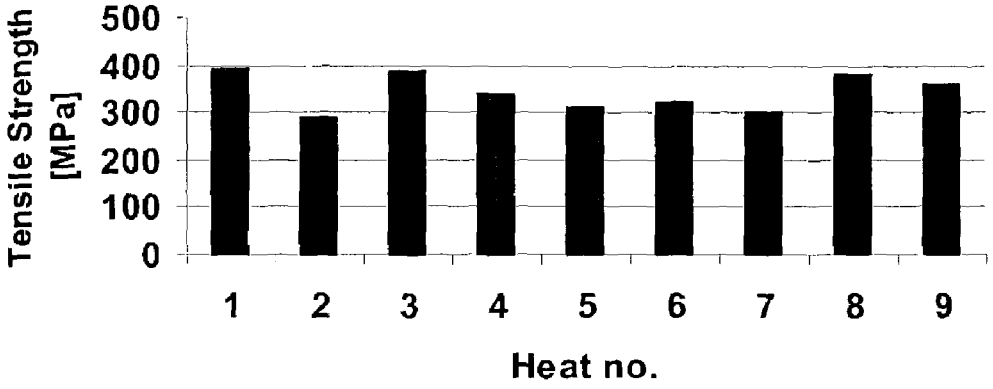
FIG. 2 shows yield point in tension for the heats 1 to 9 according to the invention at temperature of 100° C.1
Figure 3:
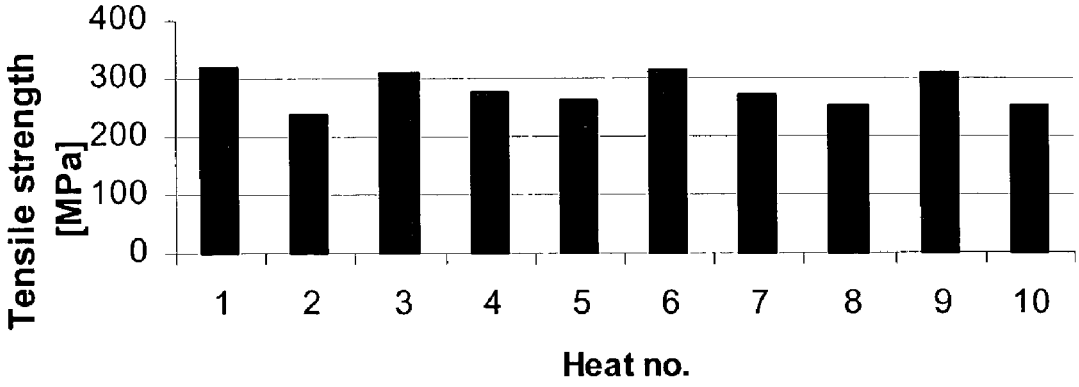
FIG. 3 shows yield point in tension for the heats 1 to 10 according to the invention at a temperature of 200° C.
Figure 4:
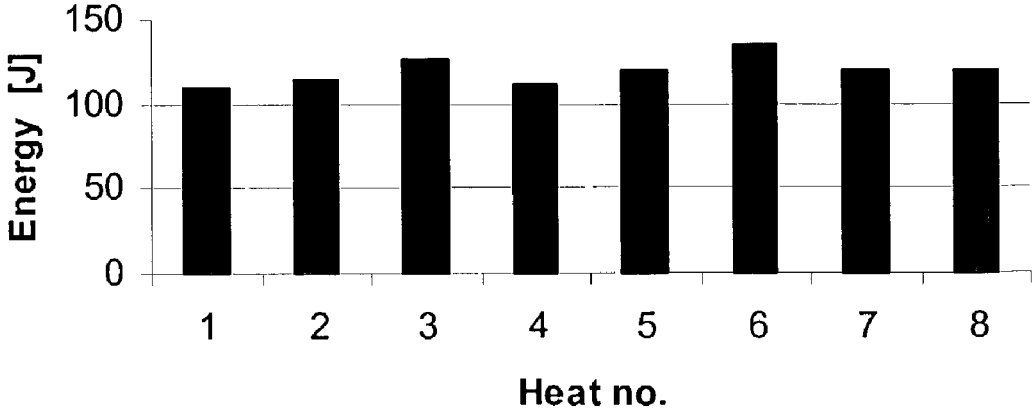
FIG. 4 shows result of impact test for bars or rods of the heats 1 to 8 according to the invention at room temperature, average of three tests.
Figure 5:
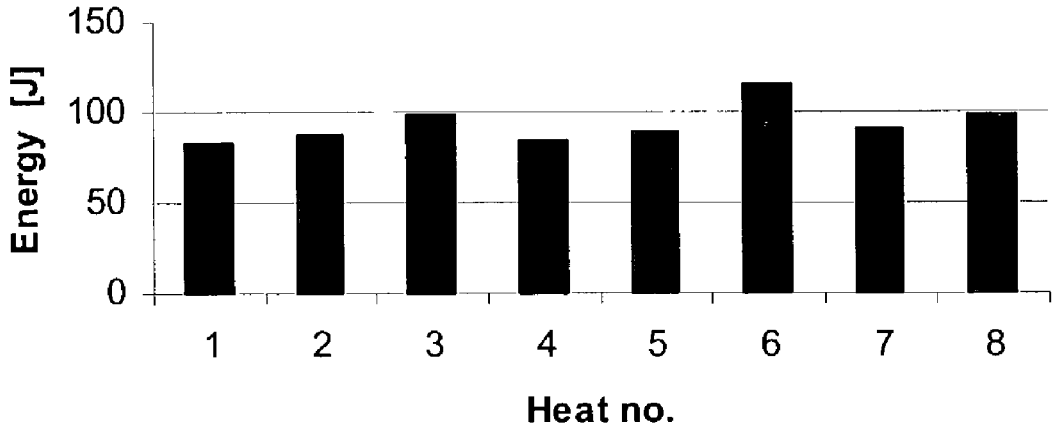
FIG. 5 shows result of impact test for bars or rods of the heats 1 to 8 according to the invention at −196° C., average of three tests.
Figure 6:
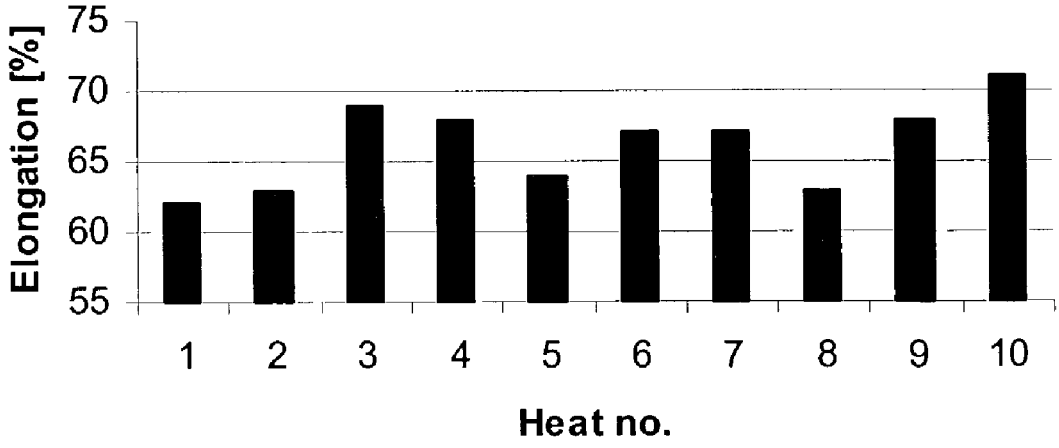
FIG. 6 shows elongation for heats 1 to 10 according to the invention at temperature of 200° C.
Figure 7:
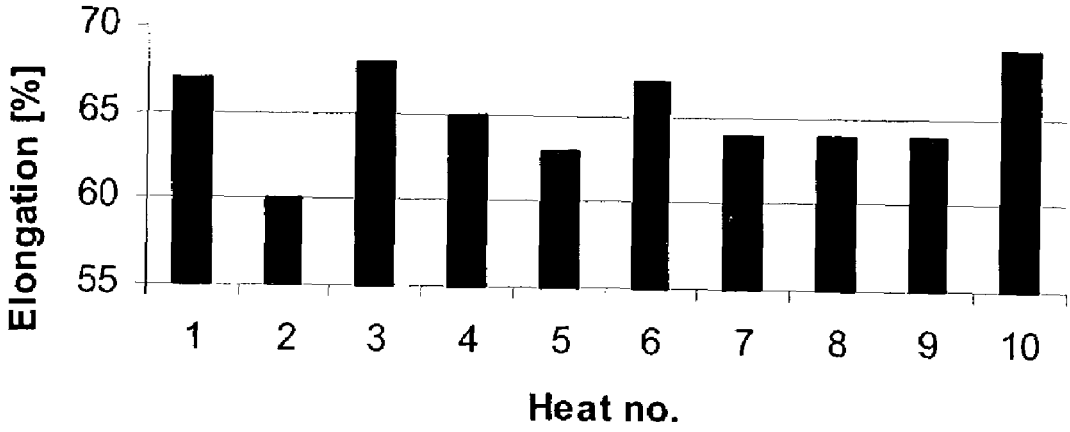
FIG. 7 shows elongation for heats 1 to 10 according to the invention at room temperature.
Figure 8:
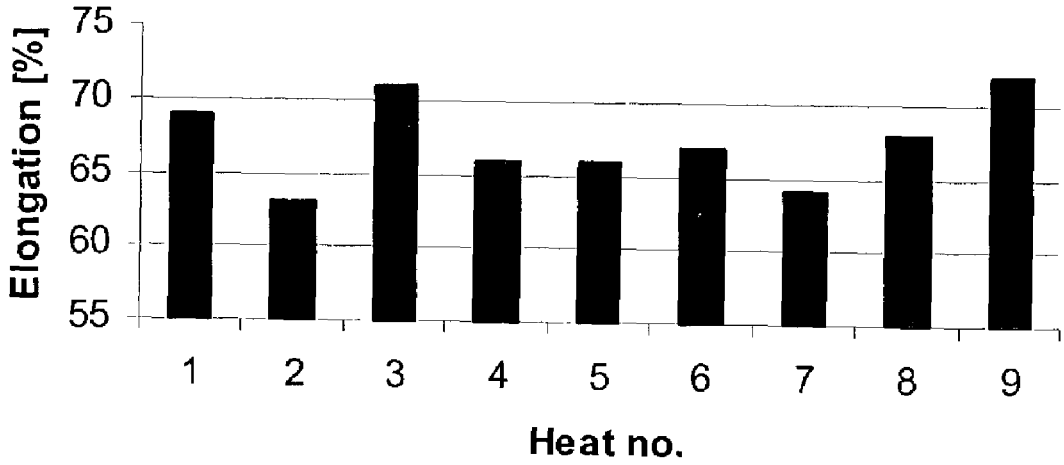
FIG. 8 shows elongation for heats 1 to 9 according to the invention at temperature of 100° C.

The tensile strength was measured by a tensile test at room temperature (RT) FIG. 1, 100° C. FIG. 2, and 200° C. FIG. 3. At each temperature two specimens of each material variant were tested. Variant 8 was not tested at 100° C. The result (yield strength and elongation) is presented as an average of the two values from each material variant. The impact strength by impact testing at room temperature, see e 4 and −196° C., see FIG. 5. Generally three specimens were used at each temperature and the results are presented as average of these three. For heats 1–8 half specimens (5×10 mm cross section area) were used and for heats 11–12 entire test specimen (10×10 mm cross section area) were used. The yield strengthen for the best heats lies at 450 MPa at room temperature and at 320 MPa at 200° C. Elongation values (A) were generally high, 60–70%, see FIGS. 6–8. For example, FIG. 6 shows elongation values for heats 1 to 10 from 62% to 71%; FIG. 7 shows elongation values for heats 1 to 10 from 60% to 69%; and FIG. 8 shows elongation values for heats 1 to 9 from 63% to 72%. The impact strength for the best heats is 300 J/cm$^2$ at RT and ca 220 J/cm$^2$ at −196° C.

Example 7

In order to measure the degree of intergranular corrosion Huey-testing was executed according to standard ASTM A262-c in 65% $HNO_3$, during 5×48 hours with double tests. All heats were tested, except heat no. 8. The results are shown as average of two specimens average corrosion during the five periods. The corrosion rate the tested heats is shown in FIG. 9. It appears the corrosion rate varies between 0.06 and 0.16 mm/year.

While the present invention has been described by reference to the above-mentioned embodiments, certain modifications and variations will be evident to those of ordinary skill in the art. Therefore, the present invention is limited only by the scope and spirit of the appended claims.

What is claimed is:

1. A tube formed from a super-austenitic stainless alloy with a combination of high corrosion resistance, good general corrosion resistance and good structure stability comprising in weight-percent:

| | |
|---|---|
| Cr | 23.0–30.0 |
| Ni | 30.0–35.0 |
| Mo | 2.0–7.0 |
| Mn | 3.0–6.0 |
| N | 0–0.4 |
| C | up to 0.05 |
| Si | up to 1.0 |
| S | up to 0.02 |
| Cu | up to 3.0 |
| W | 0–6.0 |
| Ce | 0.01–0.06 |

up to 2.0 of one or more elements of the group Mg, Ca, B, La, Pr, Zr, Ti, and Nd, and the balance being Fe and normally occurring impurities and steel making additions, wherein an elongation of the super-austenitic stainless alloy is about 60 to 72%.

2. The tube according to claim 1, wherein the content of chromium is 24.0–30.0 weight-%, the content of molybdenum is 3.7–6.0 weight-%, the content of carbon is max 0.03 weight-% and the content of silicon is max 0.8 weight-%.

3. The tube according to claim 1, wherein the content of sulfur is max 0.002 weight-%.

4. The tube according to claim 1, wherein the content of chromium is 27.0–29.0 weight-%, the content of molybdenum is 4.0–5.5 weight-%, the content of carbon is max 0.03 weight-%, the content of silicon is max 0, weight-% and the content of sulfur is max 0.002 weight-%.

5. The tube according to claim 1, wherein the content of tungsten is 0–4.0 weight-%.

6. The tube of claim 1, wherein the content of N is greater than -, the content of C is greater than -, the content of Si is greater than 0, and the content of S is greater than 0.

7. The tube of claim 1, wherein the tube comprises a heat exchanger tube having at least one cold-worked u-shaped bend.

8. The tube of claim 1, wherein the tube comprises a welded or seamless tube.

9. The tube according to claim 4, wherein the content of Mn is 4–6 weight-%.

10. The tube according to claim 1, wherein the content of N is 0.2–0.4 weight-%.

11. The tube according to claim 4, wherein the content of N is 0.2–0.4 weight-%.

12. The tube according to claim 1, wherein the content of Cu is max 1.5 weight-%.

13. The tube according to claim 1, wherein the content of the one or more elements of the group Mg, Ca, B, La, Pr, Zr, Ti, and Nd is >0 to 2.0 weight-%.

14. A tube formed from a super-austenitic stainless alloy with a combination of high corrosion resistance, good general corrosion resistance and good structure stability comprising in weight-percent:

| | |
|---|---|
| Cr | 23.0–30.0 |
| Ni | 26.0–35.0 |
| Mo | 2.0–7.0 |
| Mn | 3.0–6.0 |
| N | 0–0.4 |
| C | up to 0.05 |
| Si | up to 1.0 |
| S | up to 0.02 |
| Cu | up to 3.0 |
| W | >0–6.0 |

up to 2.0 of one or more elements of the group Mg, Ce, Ca, B, La, Pr, Zr, Ti, and Nd, and the balance being Fe and normally occurring impurities and steel making additions, wherein an elongation of the super-austenitic stainless alloy is about 60 to 72%.

15. The tube according to claim 14, wherein the content of chromium is 24.0–30.0 weight-%, the content of molybdenum is 3.7–6.0 weight-%, the content of carbon is max 0.03 weight-% and the content of silicon is max 0.8 weight-%.

16. The tube according to claim 14, wherein the content of sulfur is max 0.002 weight-%.

17. The tube according to claim 14, wherein the content of chromium is 27.0–29.0 weight-%, the content of nickel is 30.0–35.0 weight-%, the content of molybdenum is 4.0–5.5 weight-%, the content of carbon is max 0.03 weight-%, the content of silicon is max 0, weight-% and the content of sulfur is max 0.002 weight-%.

18. The tube according to claim 17, wherein the content of Mn is 4–6 weight-%.

19. The tube according to claim 17, wherein the content of N is 0.2–0.4 weight-%.

20. The tube according to claim 14, wherein the content of tungsten is up to 4.0 weight-%.

21. The tube of claim 14, wherein the content of N is greater than 0, the content of C is greater than 0, the content of Si is greater than 0, and the content of S is greater than 0.

22. The tube according to claim 14, wherein the content of N is 0.2–0.4 weight-%.

23. The tube according to claim 14, wherein the content of Cu is max 1.5 weight-%.

24. The tube according to claim 14, wherein the content of the one or more elements of the group Mg, Ge, Ca, B, La, Pr, Zr, Ti, and Nd is >0 to 2.0 weight-%.

25. The tube of claim 14, wherein the tube comprises a heat exchanger tube having at least one cold-worked u-shaped bend.

26. The tube of claim 14, wherein the tube comprises a welded or seamless tube.

27. The tube according to claim 22, wherein the content of N is about 0.4 weight-%.

28. The tube according to claim 10, wherein the content of N is about 0.4 weight-%.

* * * * *